US006654040B2

(12) United States Patent
Kasperchik et al.

(10) Patent No.: US 6,654,040 B2
(45) Date of Patent: Nov. 25, 2003

(54) METHOD FOR CREATING DURABLE ELECTROPHOTOGRAPHICALLY PRINTED COLOR TRANSPARENCIES USING CLEAR HOT STAMP COATING

(75) Inventors: Vladek P Kasperchik, Corvallis, OR (US); David J. Arcaro, Boise, ID (US); David M Kwasny, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 68 days.

(21) Appl. No.: 09/843,475

(22) Filed: Apr. 26, 2001

(65) Prior Publication Data

US 2002/0158960 A1 Oct. 31, 2002

(51) Int. Cl.[7] ..... B41J 2/325
(52) U.S. Cl. ..... 347/213
(58) Field of Search ..... 347/213, 221, 347/101; 428/175; 118/101; 156/234, 235

(56) References Cited

U.S. PATENT DOCUMENTS

| | | | | | |
|---|---|---|---|---|---|
| 5,196,241 | A | * | 3/1993 | Burke et al. | 118/101 |
| 5,229,188 | A | | 7/1993 | Takeuchi et al. | 428/195 |
| 5,352,553 | A | | 10/1994 | Takeuchi et al. | 430/42 |
| 5,354,639 | A | | 10/1994 | Kasuya et al. | 430/109 |
| 5,380,394 | A | * | 1/1995 | Shibuya et al. | 156/234 |
| 5,437,913 | A | | 8/1995 | Asaka et al. | 428/195 |
| 5,500,321 | A | | 3/1996 | Kasuya et al. | 0430/109 |
| 5,644,350 | A | * | 7/1997 | Ando et al. | 347/101 |
| 5,678,154 | A | | 10/1997 | Chen et al. | 399/331 |
| 5,864,357 | A | * | 1/1999 | Akutsu | 347/221 |
| 5,877,111 | A | * | 3/1999 | Bennett et al. | 428/195 |
| 5,958,169 | A | * | 9/1999 | Titterington et al. | 156/235 |

FOREIGN PATENT DOCUMENTS

| | | | |
|---|---|---|---|
| EP | 0 530 020 | 3/1993 | G03G/9/087 |
| JP | 63080273 | 4/1988 | G03G/15/01 |

OTHER PUBLICATIONS

US 5,032,440, 7/1991, Takeuchi et al. (withdrawn)

* cited by examiner

*Primary Examiner*—Lamson Nguyen
*Assistant Examiner*—K. Feggins
(74) *Attorney, Agent, or Firm*—W. Bradley Haymond

(57) ABSTRACT

Clear hot stamp coating methods of creating durable protective coatings to the printed side of printed transparencies.

38 Claims, 3 Drawing Sheets

METHOD FOR CREATING DURABLE ELECTROPHOTOGRAPHICALLY PRINTED COLOR TRANSPARENCIES USING CLEAR HOT STAMP COATING

BACKGROUND OF THE INVENTION

Color images can be electrophotographically or inkjet printed on transparencies. Such colored images are then projected onto a screen by an overhead projector. When such transparencies are electrophotographically color printed, many of the toner particles deposited on the transparency are only partially fused to the transparency. This partial fusion results in high surface roughness on the side of the transparency printed with the toner. When the images created by the toner particles are projected onto a screen, there is significant light scattering that gives a gray look to the projected image. This light scattering phenomenon and the resultant grayish cast in the projected image is not only caused by poorly fused toner particles. The presence of variations in toner layer thickness (up to 20 $\mu$m) also contributes to this phenomenon.

Solutions have been previously proposed to alleviate the above light-scattering problem. One solution is to apply a single sided, transparent, pressure-sensitive adhesive laminate to the printed side of an electrophotographically printed transparency. Such pressure-sensitive adhesive laminates have the disadvantage of being relatively thick in comparison to the transparencies. Therefore when the laminate and transparency layers adhere together, large air bubbles become easily trapped between the two layers.

Another solution to the light scattering problem is to apply an oil coating to the printed side of the electrophotographically printed transparency. If the oil coating refractive index matches the refractive index of the toner resin on the transparency, light scattering decreases. However, such an oil coating gives the coated side of the laminate a sticky and/or greasy feel.

Yet another solution is laminating a second transparency to the printed side of the electrophotographically printed transparency. The disadvantage of this solution is that, like the pressure-sensitive adhesive laminate described above, laminating a second transparency adds a layer of significant thickness to the electrophotographically printed transparency. This other layer is very likely to trap air bubbles. Furthermore, the significant relative thickness of the second transparency requires higher temperature and pressure and longer exposure time to fuse the transparency to the printed side of the electrophotographically printed transparency.

In Japanese Laid-Open Patent Application (KOKAI) No. 80273/1988, specific examples of methods of smoothing unfused color toner particles on a transparency are given. Specific examples of such a smoothing method include:

(1) one wherein the toner particles are fixed at a temperature at which they are sufficiently fused (2) one wherein the toner particles are fixed by using a solvent such as toluene;

(3) one wherein the fixed image is ground; and (4) one wherein a transparent paint not dissolving the toner is applied onto the fixed image.

In the three patents of Takeuchi et al. (U.S. Pat. Nos. 5,032,440; 5,229,188; and 5,352,553)(Assigned to Canon), Column 1, line 50, to Column 2, line 46, the disadvantages of the above methods of Japanese Laid-Open Patent Application (KOKAI) No. 80273/1988 are discussed as follows:

"In the case of the above-mentioned method (1) wherein the fixing is effected at a high temperature by using a fixing roller, when a half-tone portion having a small amount of toner particles is intended to be smoothed, a so-called offset phenomenon occurs in a portion having a large amount of toner particles (e.g., a black portion wherein cyan toner, magenta toner and yellow toner are co-present). When a non-contact-type heat fixing device such as oven is used, the transparent film is waved and a considerable period of time is required in order to obtain sufficient transmittance.

"In the case of the above-mentioned method (2) using a solvent, when the toner particles are sufficiently fluidized by use of a solvent so that those constituting a half-tone portion lose their particulate property, distortion or flow of an image occurs in a high-image density portion.

"In the case of the above-mentioned method (3) using the grinding of an image, the transmittance is increased in a portion having a relatively large amount of toner particles, but the particulate property of those constituting a low-image density portion is not sufficiently removed. As a result, it is difficult to remove shadows due to the peripheries of the toner particles.

"In the case of the above-mentioned method (4) wherein a transparent paint not dissolving toner particles is applied onto a toner image, clear boundaries or interfaces can sometimes be formed between the toner particles and the paint, whereby black absorption occurs in a reflection-type overhead projector due to light scattering caused by the boundaries.

"Incidentally, in order to enhance the color reproducibility in a full-color image, there may be used a binder resin for color toner such that it provides high fluidity and a low-viscosity state (about $10^4$ poise) at the time of fixing. In order to fix the low-viscosity toner without causing high-temperature offset (i.e., an offset phenomenon such that when a color toner image formed on the transparent laminate film is fixed by a fixing means such as heat pressure roller, the melted toner image adheres to the heat pressure roller), a dimethylsilicone oil having a viscosity of 100–1,000 cs (centistokes) is ordinarily used as a supplemental release agent. Accordingly, in the case of the above-mentioned method (4), when the dimethylsilicone oil is used, the paint cannot sufficiently adhere to the transparent film, where it causes new image unevenness."

The Takeuchi et al. patents treat the light-scattering problem by having a transparent laminate film, including at least a first transparent resin layer comprising a transparent resin having a heat-resistance, and a second transparent resin layer disposed thereon comprising a transparent resin, wherein the transparent resin of the second transparent resin layer has a compatibility with a binder resin of a toner to be fixed thereon, and has a larger elasticity than that of the binder resin of the toner at a fixing temperature of the toner.

Thermal transfer overcoats (TTO) also known as transfer ribbons, thermal transfer ribbons, hot stamping foils, roll foils, and transfer printing foils, are used by a number of different industries. Thermal transfer printing is a popular method for producing on-demand printed images, barcodes, receipts, and labels. This market uses solid fill colored ribbons to create images on a base media, and potentially a clear ribbon to provide added durability improvement.

SUMMARY OF THE INVENTION

The present invention relates to a method of applying a protective overcoat to a surface of a printed transparency to create a transparency with a protective overcoat, comprising: applying heat and pressure to a donor web having a carrier side comprising carrier ribbon material and a transfer side comprising protective overcoat material, wherein the heat and pressure facilitate release of a section of the transfer side from adhering to the carrier side of the donor web and facilitate transfer of the section of the transfer side to adhering to the surface of the transparency.

The present invention also relates to an overcoat for a printed transparency and the transparency itself to which the overcoat is applied, the overcoat on the transparency being made by the above-described method.

The present invention also relates to a donor web providing a protective overcoat to a printed transparency, the donor web having:

a) a carrier side comprising a carrier ribbon material and a lubricant layer as an exterior layer preventing wear of a surface of a heating element or pressing element, the surface coming in contact with the carrier side of the donor web;

b) a transfer side comprising a protective overcoat material, a release layer as an interior layer adjacent to the carrier side, the release layer facilitating release of the transfer side from the carrier side; and an adhesive layer as an exterior layer of the transfer side, the adhesive layer enhancing adhering of a section of the transfer side to form the protective overcoat on the transparency.

The present invention also relates to an apparatus comprising a donor web having a carrier side comprising carrier ribbon material and a transfer side comprising protective overcoat material, and a means of applying a protective overcoat to at least one surface of a printed transparency, by applying heat and pressure to the donor web, wherein the heat and pressure facilitate release of a section of the transfer side from adhering to the carrier side of the donor web and facilitate transfer of the section of the transfer side to adhering to the at least one surface of the transparency.

DETAILED DESCRIPTION OF THE PREFERRED EMBODIMENT

Figure 1:
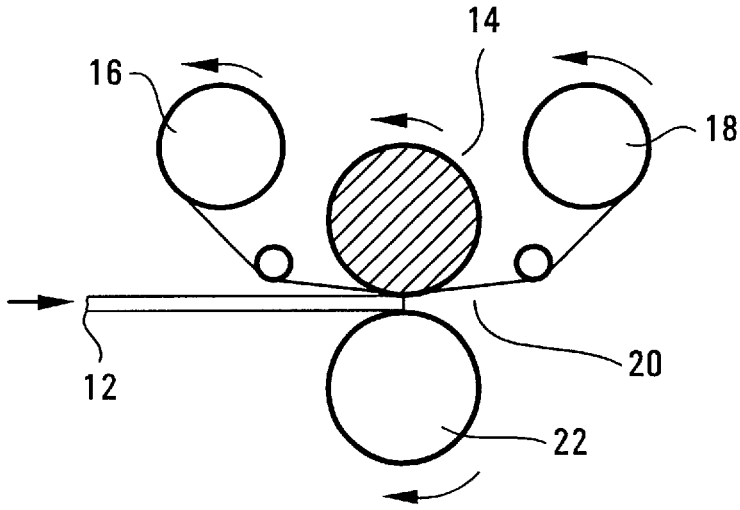
FIG. 1 is a schematic view of a preferred embodiment of the apparatus of the present invention during application of a protective overcoat onto the printed transparency (12), showing a transparency (12), a heat roll (14), a pressure roll (22), a carrier source roll (16) a carrier take-up roll (18), and a tensioned section of the donor web (20), the tensioned section being heated and pressed between the heat roll (14) and the pressure roll (22) onto the transparency (12).

The overcoats and media of the present invention are obtained by transferring thermal transfer material from a donor web which has a top side of carrier ribbon material, the carrier ribbon material anchoring the bottom side which has at least one layer of thermal transfer material. As the donor web is heated and pressed into contact with the printable surface of a printed transparency (the transparency being either electrophotographically printed or inkjet printed), the thermal transfer material is transferred onto the printed surface.

The printing processes of the present invention can include, but are not limited to imaging means used in liquid electrophotography, electrophotography, inkjet printing and conventional photography.

Besides increasing image quality by fusing poorly fused toner particles and smoothing out variations in toner layer thickness, the clear thermal transfer overcoat film of the present invention improves image quality and increases durability of the images. For example, the overcoat film provides good protection against various substances that might spill, either in the form of liquid or dry spills, on the surface of a print. Non-limiting examples of substances which the present invention would protect against would be water, alcohol, ink, coffee, soda, ammonia based or other cleaning liquids, food stains (e.g. mustard, chocolate, berry), and dirt.

The clear, thermal transfer overcoat film can be applied in a way that provides, for example, a gloss finish or a matte finish. This may be achieved through the control of the application temperature, pressure, and speed. In addition, the creation of patterns using a thermal bar as the heating element can be used to create unique matte or patterned finishes.

The composition of the overcoat film can also be formulated to target specific properties. It can be formulated to achieve a specific gloss or matte level, and to enhance the gloss uniformity or the matte uniformity. The thermal transfer material can also be formulated with materials or additives which improve the printed image, specifically, indoor light fade resistance, UV light fade resistance, resistance to water and other liquids, vapor resistance, scratch resistance and blocking resistance. In a preferred embodiment, the thermal transfer material composition can also be formulated to have a colorless or color-tinted appearance, provide a flexible, conformable coating, decrease the required dry time, optimize the adhesion of the thermal transfer film to the transparency, optimize the release of the thermal transfer overcoat from the donor web, and minimize the adhesion of the thermal transfer overcoat to the base.

In addition, within the carrier ribbon material and the thermal transfer material, there can also be layers that enhance the transfer of the thermal transfer material to the printable surface of the transparency. These additional layers can include, for example, an adhesive layer positioned as the exterior layer of the thermal transfer material. The primary function of this adhesive layer is to enhance the fixation of the thermal transfer material onto the printed surface of the transparency. Another example is a release layer positioned on the interior surface of the thermal transfer material next to the interior surface of the carrier ribbon material. The adhesive layer and the release layer can also include additives which enhance indoor and UV lightfade resistance, resistance to water and other liquids, vapor resistance, scratch resistance and blocking resistance in the printed images on the printable surface.

The thermal transfer materials should be flexible. Materials should be selected such that the final film conforms to the surface of the transparency. During application, the material should not crack or break, thereby leaving blemishes, image degradations, or exposed medium.

Non-limiting examples of light resisting additives that can be added to the thermal transfer material to be transferred to the printed surface of the transparency in the form of a clear overcoating are the hindered amine series light stabilizers. The hindered amine series light stabilizer can include commercially available hindered amine series light stabilizers having a property of dispersing within a region which it can react with a dye molecule and deactivate an active species. Preferable specific examples of such hindered amine series light stabilizers include TINUVIN 292, TINUVIN 123, and TINUVIN 144 (trademarks, produced by Japan Ciba-Geigy Company).

Besides the hindered amine series light stabilizers, the thermal materials can also include UV absorbers, which can include, but are not limited to, the benzophenone series UV absorbers, benzotriazole series UV absorbers, acetanilide series UV absorbers, cyanoacrylate series UV absorbers, and triazine series UV absorbers. Specific preferred examples are commercially available acetanilide series UV absorbers such as Sanduvor UVS powder and Sanduvor 3206 Liquid (trademark names, produced by Sando Kabushiki Kaisha); and commercially available benzotriazole series UV absorbers such as TINUVIN 328, TINUVIN 900, TINUVIN 1130, and TINUVIN 384 (trademark names, produced by Japan Ciba-Geigy Company), and Sanduvor 3041 Dispersion (trademark name, produced by Sando Kabushiki Kaisha).

Non-limiting examples of liquid resistance additives or vapor resistance additives which can be added to the thermal transfer material layers, to be transferred to the printed surface of the transparency in the form of a clear overcoating are additives that decrease the wettability of the surface by decreasing the surface energy, thereby repelling liquids such as (but not limited to) water from the surface. These additives may include the family of fluoro-surfactants, silanes, siloxanes, organosiloxanes, siliconizing agents, and waxes or combinations thereof.

In addition to the use of additives to increase the liquid or vapor resistance, the formulation of the layers can provide improvements. Individual thin layers may develop pits or pin holes in their surface during their coating to the carrier. These holes provide avenues for liquid or vapor to travel down to the printed surface. By increasing the number of layers used to create the final overcoat, the probability of a pinhole extending all the way through the entire layer stack is decreased. In addition, this allows the individual layers to be optimized for a unique performance attribute, whereas it may not be possible to acquire as large a range of attributes from a single layer. For example, an upper layer may be optimized for gloss, and it may cover a lower layer optimized for light fade resistance. The combination of the two may be the same thickness as a single layer that has lower gloss and inferior light fade and liquid resistant properties due to the tradeoffs associated with formulating that single layer.

The present invention makes possible very thin individual layers on a transparency that can be applied either as transparent or opaque layers. Thus, in one embodiment of the invention it is possible to apply thin protective layers as both undercoating and overcoating to a transparency, achieving durability and protection of print qualities without sacrificing good optical or media qualities in the finished product.

One of the layers in the coating may consist of material having barrier properties (i.e., having very low permeability toward gases (e.g., oxygen or water vapor)). Examples of the most widely used materials with barrier properties are copolymers of acrylonitrile or co-polymers of vinylidene chloride or vinylidene fluoride. Use of materials with barrier properties in the overcoat makes it possible to dramatically increase protection of the overcoated print from humidity and fade (partially caused by oxidation of the colorants.

The transparency may also include or be coated with materials which increase adhesion of inkjet dyes or pigments, increase adhesion of the overcoat material, optimize image quality, increase resistance to scratches, increase resistance to fading, increase resistance to moisture, or increase resistance to UV light. Such materials include, but are not limited to polyesters, polystyrenes, polystyrene-acrylic, polymethyl methacrylate, polyvinyl acetate, polyolefins, poly(vinylethylene-coacetate), polyethylene-co-acrylics, amorphous polypropylene and copolymers and graft copolymers of polypropylene.

One of ordinary skill in the art will understand that an image can be applied to a printed surface of the transparency using commonly known and available means, such as electrostatic printing.

In a preferred embodiment of the present invention, the heating element used for transfer is selected from a group consisting of a heated roller, a ceramic heat bar, a heat die or a thermal printhead. A heated roller, similar to what is used in most commercial laminators or many electrophotograpic printers, provides a good means of providing uniform, continuous, full width transfer of the overcoat. A ceramic heat bar, similar to what is used in many monochrome electrophographic printers (a.k.a. instant-on fusers), also provides a good means of providing uniform, continuous, full width transfer of the overcoat. In addition, ceramic elements have a lower thermal mass than a typical heated roller, thus they quickly reach the desired transfer temperature and quickly cool following transfer, thereby enhancing energy efficiency and reducing start-up time. A thermal printhead or heat die, similar to what is used in thermal transfer, dye sublimation printers or faxes, provides a good means of providing continuous or intermittent, full width or discrete, transfer of the overcoat. The heating element can be rigid, or it may be compressible, with the compression level influencing the nip area.

In another preferred embodiment of the present invention, the medium is positioned over a base, and the heating element and base are pressed towards each other to create a nip area. The base can be rigid, or it can be compressible, with the compression level influencing the nip area. The base may be coated with a non-stick (non-wetting), heat-resistant surface. A solid lubricant can be used to provide this surface. The solid lubricant may be a fluororesin, fluorocarbon, or fluoropolymer coating such as (poly)-tetrafluoroethylene (PTFE), perfluoroalkoxy (PFA), fluorinated ethylene propylene (FEP), ethylene tetrafluoroethylene (ETFE), ethylene chlorotrifluoroethylene (ECTFE), polyvinylidene fluoride (PVDF), with trade names such as Teflon, Silverstone, Fluoroshield Magna, Cerm-a-lon, Magna TR, Navalon, Apticote, or Edlon. In addition a replenished liquid lubricant, such as silicone oil, can be used to provide this non-stick surface.

In a preferred embodiment of the present invention, the heating element, the base (or pressure element) and the donor web span beyond the width of the printable surface of the transparency to be coated. During application, the heating element and base maintain a constant nip force and area across the donor web, which is in contact with the transparency. Since the donor web and nip area extend beyond the print sides, full coating to all print edges is insured. The non-stick base surface ensures that the overcoat is only transferred to the printable surface and not to the surrounding non-stick surface of the base. Only that portion of the thermal transfer overcoat that touches the printable surface separates from the donor web. The rest, including the thermal transfer material overcoat portion extending beyond the edges, remains connected to the donor web. The present design also provides the added feature in that one source of overcoat can be used to coat any print size narrower than the source, without the need for post process trimming.

When not being applied, the heating element may be removed from the donor web and base surfaces, thereby discontinuing transfer and allowing feed of the transparency under and away from the heater element. Also, application of the coating can be discontinued by reducing the temperature of the heating element or by reducing the nip force, which can be facilitated by raising the heating element or the combination of the heating element and donor web off the transparency surface.

Figure 3:
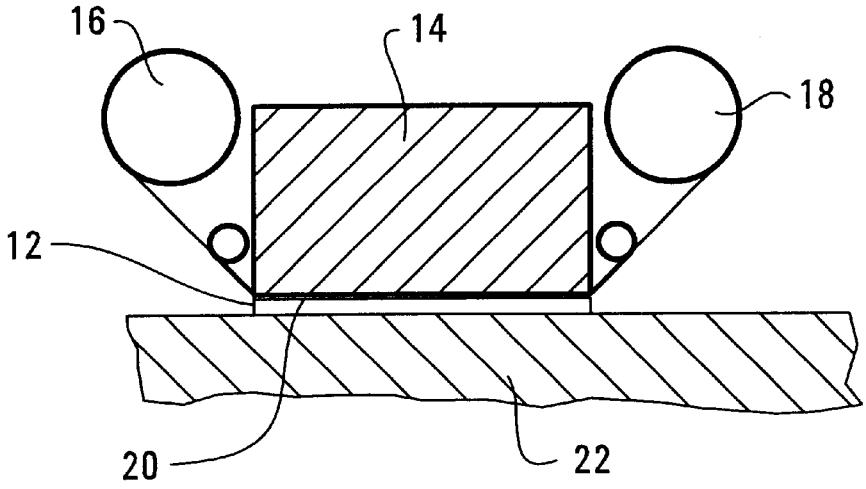
FIG. 3 is a schematic view of another preferred embodiment of the apparatus of the present invention during application of a protective overcoat onto the transparency (12), showing a transparency (12), a heat die (14), a base (22), a carrier source roll (16) a carrier take-up roll (18), and a tensioned section of the donor web (20), the tensioned section being heated and pressed between the heat die (14) and the base (22) onto the transparency (12).

In addition to limiting the area of transfer of the thermal transfer overcoat to the printable surface of the transparency by providing a non-stick surface on the base or roller under the printable surface, the area of the printable surface that actually receives a transferred section of the thermal transfer overcoat can be further limited to a specific portion of the printable surface by limiting the section of the thermal transfer overcoat to the area in which heat and pressure is applied. This can be accomplished with the use of a thermal printhead, as used in thermal transfer printers. For example, selected printed areas, such as colored images, on the printable surface can be overcoated while other printed areas, such as black and white text, can remain uncoated. Such an embodiment is shown in FIG. 3. Such selective overcoating of discrete areas on transparencies is not feasible with traditional laminates and traditional laminating processes nor other digital coating processes.

Also in a preferred embodiment of the present invention, the speed of the donor web through the heating element is maintained at the same speed as the transparency, thus ensuring a uniform coverage. A source roll of donor web is located upstream of the heating element and a take-up roll is located downstream. The source roll is torque limited with a slip clutch or similar device to tension and present the thermal transfer material on the donor web, and to allow the unrolling of the donor web concurrent with the transparency during application but ensuring that uncontrolled unrolling does not occur. The take-up roll provides enough torque to peel the donor web from the transparency's surface, but not enough to pull the donor web/transparency combination through the applicator or to distort the coating in the applicator. The take-up mechanism thus peels the donor web from the coated medium, collects the donor web, and helps maintain the uniform tension on the donor web during application.

A thermal transfer overcoat module can be offered to use, for example, as a plug-in module for an apparatus that prints on the surface of printed transparencies. A laser printer or inkjet printer in combination with a thermal transfer overcoat module would provide a compact reliable system for creating durable photo-quality prints. Alternatively, rather than having the thermal transfer overcoating capability offered as part of a plug-in module which can either be included or not included with the printer, a printer can be built which completely incorporates the thermal transfer overcoating function into an integrated printing and coating printer. Alternatively, a stand-alone coater can be used, which allows the user to hand load the already printed transparencies to be overcoated.

Covering the image with a thermal transfer material overcoat offers the advantage of providing an intimate, gap-free bond with the transparency, thus protecting the image from the outside environment.

Thermal transfer overcoating is an improvement over lamination as previously disclosed. In the present invention a thermal transfer material overcoat is transferred onto the transparency surface only at the locations that are subjected to the contact pressure and heat. Thus, it disengages from the donor web as it transfers and only the thermal transfer material and not the donor web is attached to the transparency. There is clean separation of the donor web and the overcoated transparency at all edges of the print. In contrast, in previously disclosed laminates, the transferred laminate is still attached to the overcoat supply source, until separated by a manual or automated trimming step. In the present invention, there is no need for a secondary manual or automated trimming step to disconnect the thermal overcoat supply source (the donor web) from the overcoated transparency. This also facilitates the easy feeding of transparencies.

Prints embodied in the present invention can be produced by a variety of apparatuses. Such apparatuses typically comprise the elements illustrated in FIGS. 1 through 3, though it will be appreciated that other apparatuses may be employed without departing from the scope and true spirit of the present invention.

Figure 2:
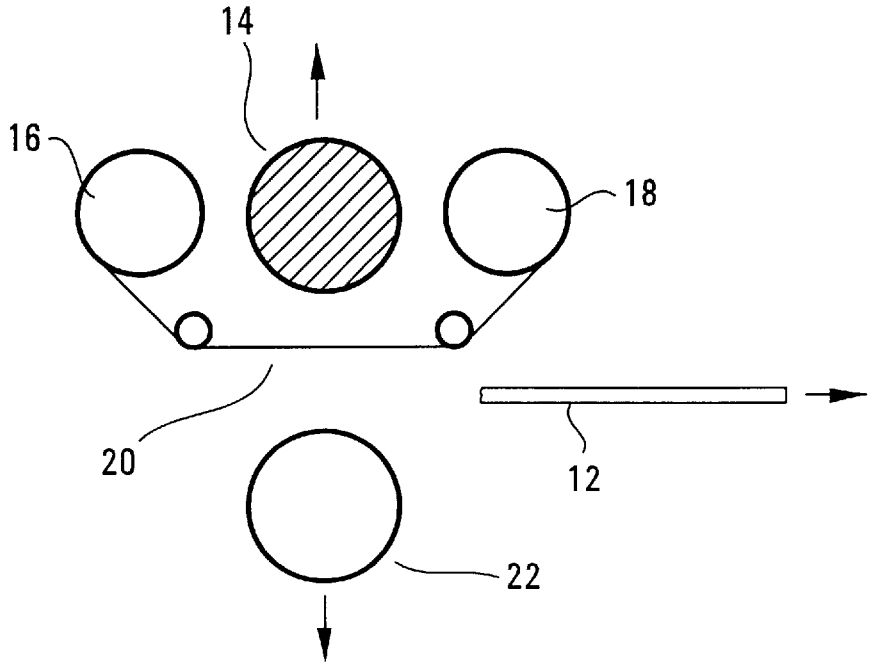
FIG. 2 is a schematic view of the apparatus of FIG. 1 after application of a protective overcoat onto the transparency (12) with the heat roll (14) and the pressure roll (22) positioned away from the tensioned section of the donor web (18) and the transparency (12) having already passed the tensioned section of the donor web (18).

As shown in FIG. 1, once a transparency (12) is loaded into the system, the take up roll (18), or other similar means, tensions a section (20) of the donor web coming from the source roll (16), and at least one heating element roll (14) heats the segment of the donor web and presses it against the medium positioned on a base (22) (which in this embodiment is in the form of a pressure roller) to transfer a segment of the thermal transfer material layer of the donor web onto the transparency (12) as it moves through the system. As shown in FIG. 2, at the end of the coating of the transparency, the heating element (14) or other similar means is raised and the pressing element (22) is lowered so that they no longer provide heat and pressure to the donor web. The thermal transfer film layer separates from the donor web during transfer up to the edges of the transparency, with the thermal transfer material layer adhering to the surface of the transparency where the pressure and heat were applied and continuing to be attached to the donor web beyond the edges of the transparency.

FIG. 2 shows the apparatus of FIG. 1 with the ribbon handler tensioning the donor web in a position away from and no longer abutting the heater and base as the transparency moves through the system. In this position, no thermal transfer material layer transfers onto the transparency as it moves through the system, and no material is collected in the take-up roll.

Figure 4:
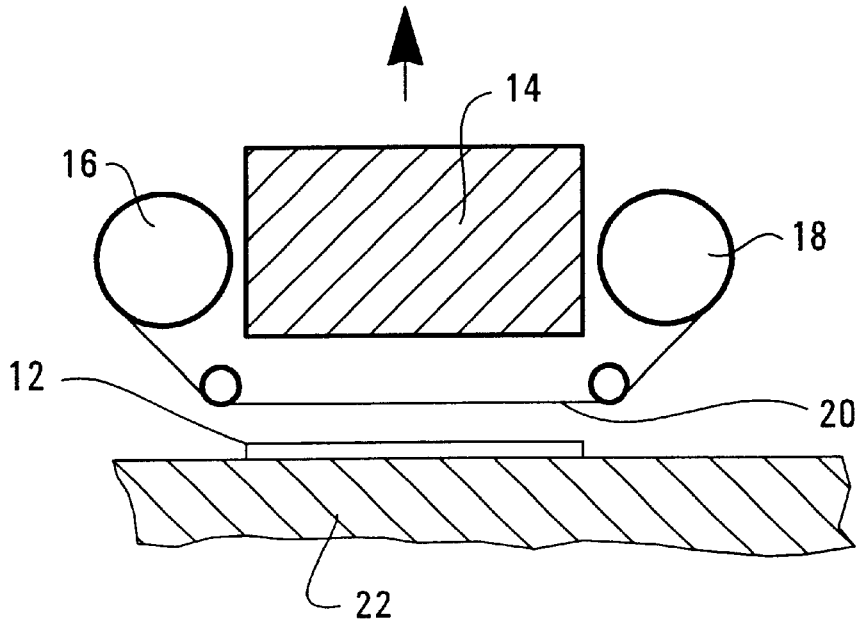
FIG. 4 is a schematic view of the apparatus of FIG. 2 after application of a protective overcoat onto the transparency (12) with the heat die (14) positioned away from the tensioned section of the donor web (18) and the transparency (12) having already passed the tensioned section of the donor web (18).

As shown in FIG. 3 once a transparency (12) is loaded into the system, the ake up roll (18), or other similar means, tensions a section (20) of the donor web coming from the source roll (16), and at least one heating element die (14) heats the segment of the donor web and presses it against the medium positioned on a base (22) (which in this embodiment is in the form of a platen) to transfer a segment of the thermal transfer material layer of the donor web onto the transparency (12) as it moves through the system. As shown in FIG. 4, at the end of the coating of the transparency, the heating die (14) or other similar means is raised above the platen (22) so that the combination of the two no longer provides heat and pressure to the donor web. The thermal transfer film layer separates from the donor web during transfer up to the edges of the transparency, with the thermal transfer material layer adhering to the surface of the transparency where the pressure and heat were applied and continuing to be attached to the donor web beyond the edges of the transparency.

FIG. 4 shows the apparatus of FIG. 3 with the ribbon handler tensioning the donor web in a position away from and no longer abutting the heating die and base as the transparency moves through the system. In this position, no thermal transfer material layer transfers onto the transparency as it moves through the system, and no material is collected in the take-up roll.

Figure 5:
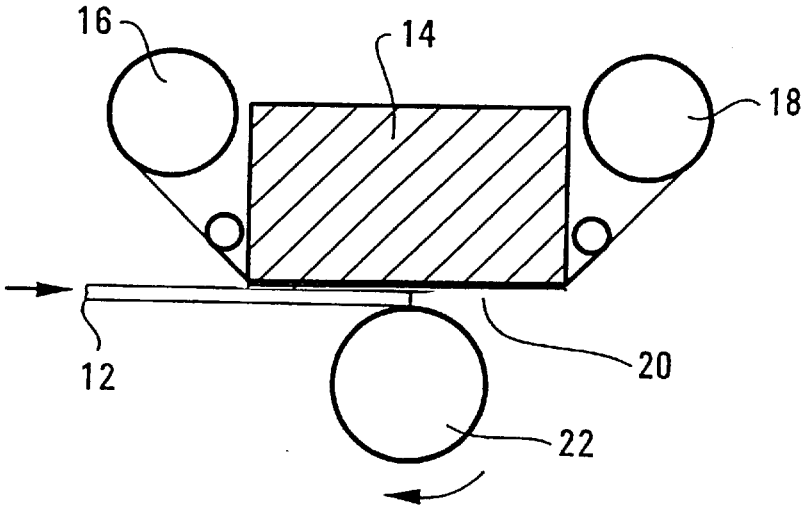
FIG. 5 is a schematic view of another preferred embodiment of the apparatus of the present invention during application of a protective overcoat onto the transparency (12), showing a transparency (12), a heat die (14), a pressure roll (22), a carrier source roll (16) a carrier take-up roll (18), and a tensioned section of the donor web (20), the tensioned section being heated and pressed between the heat die (14) and the pressure roll (22) onto the transparency (12).

As shown in FIG. 5 once a transparency (12) is loaded into the system, the take up roll (18), or other similar means, tensions a section (20) of the donor web coming from the source roll (16), and at least one heating element die (14) heats the segment of the donor web and presses it against the medium positioned on a base (22) (which in this embodiment is in the form of a pressure roller) to transfer a segment of the thermal transfer material layer of the donor web onto the transparency (12) as it moves through the system. As shown in FIG. 4, at the end of the coating of the transparency, the heating die (14) or other similar means is raised above the pressure roller (22) so that the combination of the two no longer provides heat and pressure to the donor web. The thermal transfer film layer separates from the donor web during transfer up to the edges of the transparency, with the thermal transfer material layer adhering to the surface of the transparency where the pressure and heat were applied and continuing to be attached to the donor web beyond the edges of the transparency.

Figure 6:
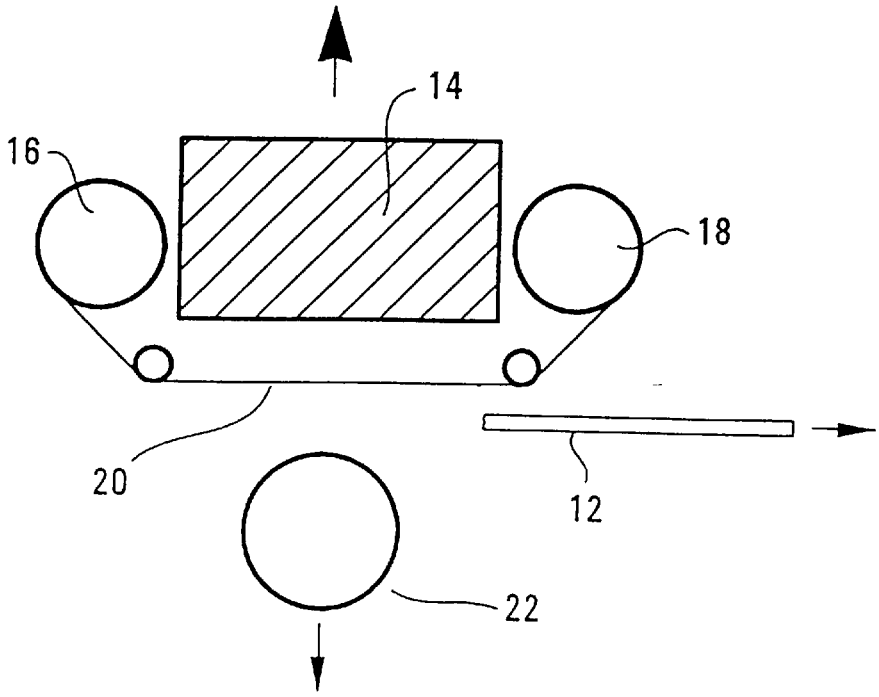
FIG. 6 is a schematic view of the apparatus of FIG. 5 after application of a protective overcoat onto the transparency (12) with the heat die (14) positioned away from the tensioned section of the donor web (18) and the transparency (12) having already passed the tensioned section of the donor web (18).

FIG. 6 shows the apparatus of FIG. 5 with the ribbon handler tensioning the donor web in a position away from and no longer abutting the heating die and pressure roller as the transparency moves through the system. In this position, no thermal transfer material layer transfers onto the transparency as it moves through the system, and no material is collected in the take-up roll.

While the foregoing invention has been described in some detail for purposes of clarity and understanding, it will be clear to one skilled in the art from the reading of this disclosure that various changes in form and detail can be made without departing from the true scope of the invention:

What is claimed is:

1. An apparatus comprising a continuous length of a donor web having a carrier side comprising carrier ribbon material and a transfer side comprising protective overcoat material, and a means of applying a protective overcoat to at least one surface of a printed transparency, by applying heat and pressure to a section of the carrier side of the donor web, wherein the applied heat and pressure, passing through the donor web to the transfer side, facilitate transfer of a section of the transfer side from the donor web to adhering to the surface of the printed transparency, and wherein the section of the carrier side receiving applied heat and pressure remains attached to the donor web.

2. The apparatus of claim 1, wherein the surface is a printable surface.

3. The apparatus of claim 1 further comprising:

a means of positioning the section of the transfer side against the surface of the printed transparency, while heat and pressure are applied to the donor web; and a base to support the printed transparency while the section of the transfer side is being positioned against the surface of the printed transparency.

4. The apparatus of claim 3, wherein the section of the transfer side transferred to adhering to the surface improves durability and quality of the printed image of the surface through addition of at least one of dry time optimization, optimization of the adhering of the section of the transfer side to the surface of the printed transparency, and optimization of release of the section of the transfer side from adhering to the carrier side of the donor web.

5. The apparatus of claim 1, wherein heat is applied to the section of the transfer side by a heating element applied to the carrier side of the donor web.

6. The apparatus of claim 5, wherein pressure is applied to the section of the transfer side by controlled contact between the heating element and the base, with the donor web and the printed transparency sandwiched between the heating element and the base.

7. The apparatus in claim 5, wherein the heating element is selected from the group consisting of a heated roller, a heated die element, a ceramic heater element, and thermal print-head heating elements.

8. The apparatus of claim 1, wherein pressure is applied to the section of the transfer side by controlled contact between a pressing element applied to a section of the carrier side of the donor web adjacent to the section of the transfer side, the donor web and the printed transparency being sandwiched between the pressing element and the base.

9. The apparatus of claim 8, wherein the pressing element comprises at least one roller element.

10. The apparatus of claim 1, wherein at least a portion of an exterior surface of the base comprises a surface material resistant to adhering to the section of the transfer side.

11. The apparatus of claim 10, wherein the surface material is selected from the group consisting of a fluororesin coating, a fluorocarbon coating, and a fluoropolymer coating.

12. The apparatus of claim 10, wherein the surface material is selected from the group consisting of (poly)-tetrafluoroethylene (PTFE), perfluoroalkoxy (PFA), fluorinated ethylene propylene (FEP), ethylene tetrafluoroethylene (ETFE), ethylene chlorotrifluoroethylene (ECTFE), polyvinylidene fluoride (PVDF), their derivatives and combinations thereof.

13. The apparatus of claim 10, wherein the surface material is silicone oil.

14. The apparatus of claim 1, wherein heat is applied to only a subsection of the section of the transfer side, so that only the subsection to which heat is applied adheres to the surface of the printed transparency.

15. The apparatus of claim 1, wherein pressure is applied to only a subsection of the section of the transfer side, so that only the subsection to which the pressure is applied adheres to the surface of the printed transparency.

16. The apparatus of claim 1, wherein the section of the transfer side has at least one of a surface width greater than the surface's surface width and a surface length greater than the surface's surface length, so that only a subsection of the section adheres to the surface, the subsection having a surface width equal to or less than the surface's surface width and a surface length equal to or less than the surface's surface length.

17. The apparatus of claim 1, wherein the base comprises at least one roller.

18. The apparatus of claim 1, wherein the base comprises a platen.

19. The apparatus of claim 1, wherein the transfer side of the donor web comprises more than one layer.

20. The apparatus of claim 19, wherein at least one layer of the transfer side comprises a barrier layer resistant to penetration by liquid and air.

21. The apparatus of claim 20, wherein the barrier layer comprises a polymeric material selected from the group consisting of polyvinylidene chloride, polyvinylidene fluoride, their derivatives and combinations thereof.

22. The apparatus of claim 19, wherein the transfer side of the donor web further comprises a release layer as an interior layer of the transfer side adjacent to the carrier side, the release layer facilitating release of the section of the transfer side from adhering to the carrier side of the donor web.

23. The apparatus of claim 1, wherein the at least one layer of the transfer side comprises thermoplastic resin material.

24. The apparatus in claim 23, wherein the thermoplastic resin material is selected from the group consisting of acrylic, polyolefin, polyester, their derivatives and combinations thereof.

25. The apparatus in claim 1, wherein the apparatus further comprises an electrophotographic printer component, the electrophotographic printer component applying a printed image to the surface of the printed transparency before the section of the transfer side is transferred to adhering to the surface of the printed transparency.

26. The apparatus in claim 1, wherein the section of the transfer side is transferred to adhering to the surface of the printed transparency, the surface having an image already applied by a printer separate from the apparatus.

27. The apparatus in claim 1, wherein the apparatus is a module installable as a component of a separate printer.

28. The apparatus of claim 1, wherein the carrier side of the donor web comprises more than one layer.

29. The apparatus in claim 28, wherein at least one layer of the carrier side is selected from the group consisting of thermoplastic resin material and high-density tissue.

30. The apparatus in claim 29, wherein the thermoplastic resin material is a polyester.

31. The apparatus of claim 28, wherein the carrier side of the donor web further comprises a lubricant layer as an exterior layer of the carrier side, the lubricant layer preventing wear of a surface of the heating element coming in contact with the carrier side of the donor web.

32. The apparatus in claim 1, wherein the section of the transfer side transferred to adhering to the surface has a surface finish selected from the group consisting of matte finish and gloss finish.

33. The apparatus in claim 1, wherein the apparatus further comprises a means of stamping at least one textured pattern onto an exterior surface of the section of the transfer side transferred to adhering to the surface of the printed transparency.

34. The apparatus in claim 1, wherein the apparatus further comprises a means of heating and pressing at least one textured pattern onto an exterior surface of the section of the transfer side transferred to adhering to the surface of the printed transparency.

35. The apparatus of claim 1, wherein the section of the transfer side transferred to adhering onto the surface has improved features selected from the group consisting of matte uniformity and gloss uniformity.

36. The apparatus of claim 1, wherein the section of the transfer side transferred to adhering to the surface improves durability of the surface through addition of at least one of indoor lightfade resistance, ultraviolet light fade resistance, resistance to liquid penetration, resistance to vapor penetration, scratch resistance, and blocking resistance.

37. The apparatus of claim 1, wherein the transfer side of the donor web further comprises an adhesive layer as an exterior layer of the transfer side, the adhesive layer enhancing adhering of the section of the transfer side to the surface of the printed transparency.

38. The apparatus of claim 1, wherein the surface of the printed transparency further comprises a layer that optimizes adhering the section of the transfer side to the surface of the printed transparency, the adhering to the surface being strong enough to facilitate release from the adhering of the section of the transfer side to the carrier side of the donor web.

* * * * *